United States Patent [19]

Guerra

[11] 4,155,141

[45] May 22, 1979

[54] CEMENT FINISHING TOOL

[76] Inventor: Charles A. Guerra, 2943 NE. 22nd Ave., Portland, Oreg. 97212

[21] Appl. No.: 869,095

[22] Filed: Jan. 13, 1978

[51] Int. Cl.[2] ..... B05C 17/10; E01C 19/44

[52] U.S. Cl. ..... 15/235.8; 15/235.3; 15/235.7

[58] Field of Search ..... 15/104 S, 105.5, 235:3, 15/235.4, 235.5, 235.6, 235.7, 235.8; 404/89, 93, 97, 119; 145/20, 6, 10; 118/109; 425/87, 458

[56] References Cited

U.S. PATENT DOCUMENTS

| | | | |
|---|---|---|---|
| 997,577 | 7/1911 | Nelk | 15/233 UX |
| 1,273,060 | 7/1918 | Hoff | 15/235.7 X |
| 1,362,900 | 12/1920 | Severns | 15/229 B |
| 1,585,571 | 5/1926 | Swanson | 404/97 |
| 1,773,431 | 8/1930 | Mosel | 404/119 |
| 1,966,489 | 7/1934 | Edge | 404/87 |
| 2,108,470 | 2/1938 | Boulton | 15/235.4 X |
| 2,226,634 | 12/1940 | Sabin | 401/9 |
| 2,420,062 | 5/1947 | Ames | 401/9 X |
| 2,674,116 | 4/1954 | Erp | 425/87 |
| 3,806,268 | 4/1974 | Francis | 404/89 |

*Primary Examiner*—Daniel Blum
*Attorney, Agent, or Firm*—Francis Swanson

[57] ABSTRACT

A tool for simultaneously finish edging the wet cement surfaces abuting both sides of divider strips which separate the wet slabs is disclosed. The tool has a pair of blades adjustable to accommodate a variety of divider thicknesses. One of the adjustable blades is spring loaded and floats so as to compensate for changes in the width of the divider as the tool moves along its length. A blade may be removed if only one edge is to be finished.

6 Claims, 3 Drawing Figures

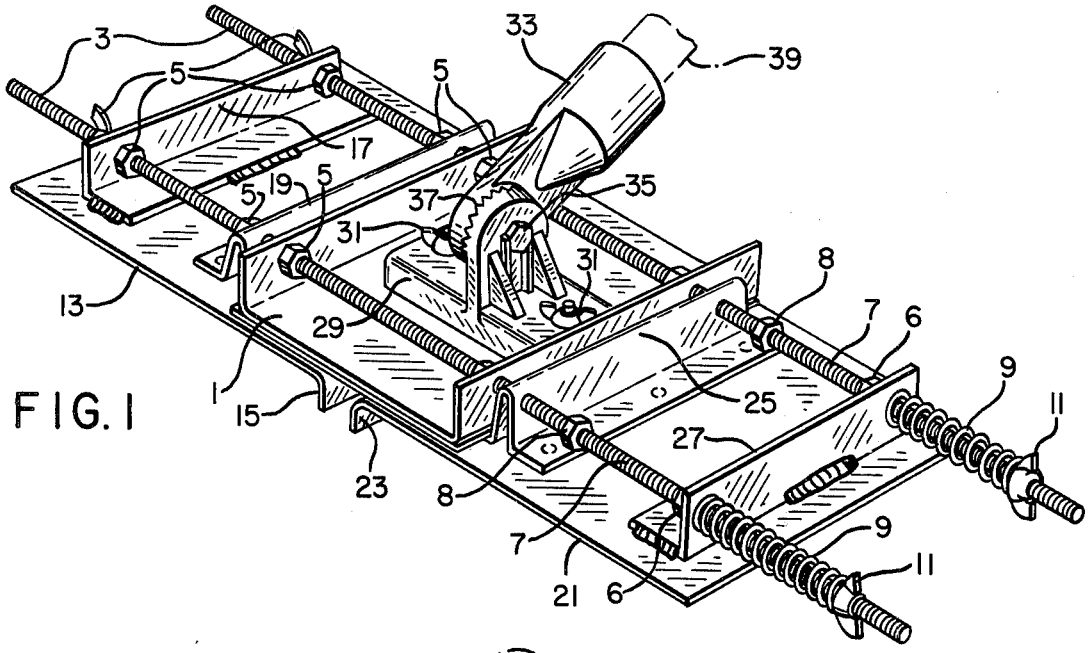
FIG. 1
FIG. 2
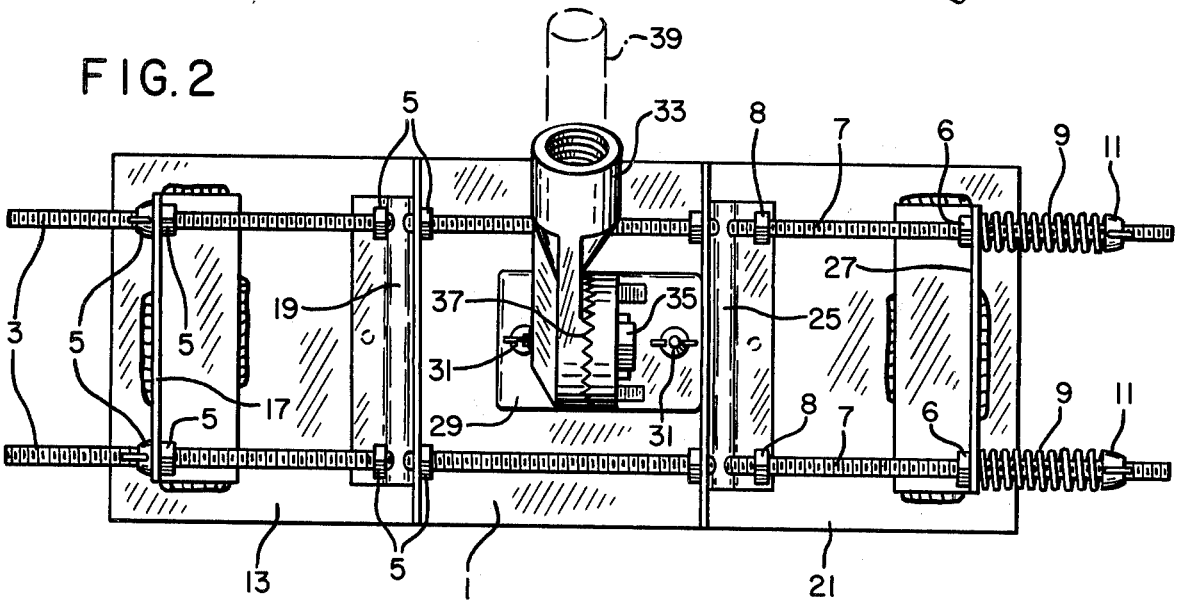
FIG. 3
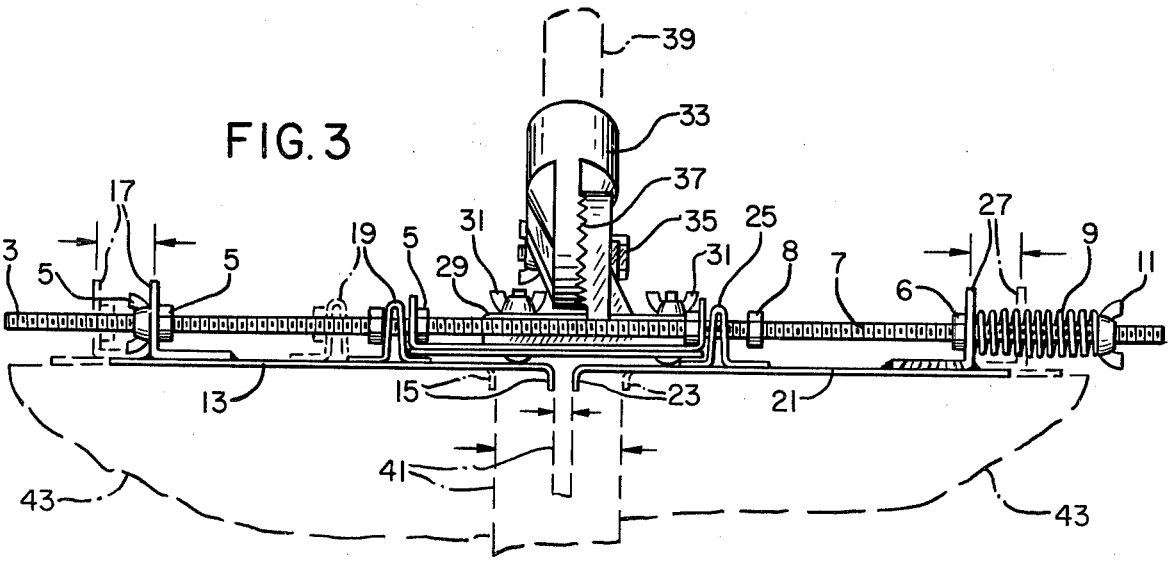

CEMENT FINISHING TOOL

BACKGROUND OF THE INVENTION

1. Field of the Invention

The invention pertains to cement finishing tools in general and more particularly to those tools capable of finish edging two slabs simultaneously.

2. Description of the Prior Art

Numerous cement finishing and edging tools are known in the prior art. Some examples are shown in the following U.S. Pat. Nos.: 1,273,060 to Hoff, 2,526,401 to Oscar and 3,045,271 to Cinotti. The patent to Hoff discloses a tool for edging both slabs along a divider, however the edging blades do not float. Thus, if the divider varys greatly in width, the tool will become wedged on the divider. The user must then stop and readjust the tool. If, as is often the case, the divider contains many variations, excessive delays and inefficient finishing can occur.

SUMMARY OF THE INVENTION

It is a principal object of the invention to provide a divider straddling tool which will efficiently and economically finish edge both wet slabs abutting a divider simultaneously.

A further object of the invention is to provide a double bladed tool where one blade floats continuously.

A further object of the invention is to provide a tool having a spring loaded blade to continuously compensate for changes in divider width.

Other objects and advantages will be apparent to those skilled in the art with reference to the accompanying drawing and specification.

BRIEF DESCRIPTION OF THE DRAWINGS

FIG. 1 is a perspective view of the tool showing the means for spring loading the floating blade.

FIG. 2 is a plan view of the tool.

FIG. 3 is an elevational view of the tool and shows different divider widths.

DETAILED DESCRIPTION

Referring now to the drawings, the tool includes a U-shaped frame 1 to which is attached a pair of blade mounting rods 3. On one end of rods 3 is a plurality of positioning nuts 5. The other end of each rod 3 defines threads 7. Over threaded end 7 of each rod 3 is fitted a spring 9, held in place by spring nut 11. Adjustment nuts 6 and stop nuts 8 are also mounted on rods 3. An adjustable blade 13 defining a downwardly curved finishing lip 15 and having two mounting brackets 17 and 19 on its upper side is attached to rods 3 under frame 1. The position of blade 13 along rods 3 can be adjusted with nuts 5. A floating blade 21 defining a downwardly curved finishing lip 23 and having mounting brackets 25 and 27 on its upper side is attached to rods 3 opposite blade 15, under frame 1. The position of blade 21 along rods 3 is adjusted by stop nuts 6. Springs 9 abut against the outside edge of bracket 27 and are loaded by wing nuts 11. The distance which blade 21 can float along the length of rods 3 is determined by the distance from brackets 25 which stop nuts $\beta$ are set.

A pivotable handle block 29 is fastened to frame 1 with wing nuts 31. A handle socket 33 is attached to block 29 by bolt 35. Serrations 37 in block 29 and socket 33 permit angular adjustment of the tool handle. A handle 39 fits into socket 33. FIG. 3 shows the tool resting on a divider 41 which is between a body of cement 43.

OPERATION

To begin use of the tool the workman first loosens nuts 5 on rods 3, the adjustable blade 13 is then set to the desired position along rods 3. Nuts 5 are then rotated until they bear against brackets 17 and 19. Nuts 6 and 8 between brackets 25 and 27 are then loosened and blade 21 is moved in or out along rods 3 until the divider will just fit in the space between lips 15 and 23. Nuts 6 are then rotated till they bear against the inside surface of bracket 27. The wing nuts 11 are then tightened against springs 9 to provide the proper spring loading. Stop nuts 8 are then backed away from bracket 25 a distance sufficient to permit the desired inward and outward floating action of blade 21 along rods 3.

The tool is then placed upon the divider 41 with lips 15 and 23 snug against either side of the divider 41.

Lips 15 and 23 are now in the wet cement body 43 and the top of the divider 41 rests against the underside of frame 1. The operator now loosens bolt 35 and moves handle 39 and socket 33 to the desired angle for comfortable usage. This angle must be adjusted as the tool moves away from the operator outward along the divider 41. Tightening of bolt 35 will draw serration 37 together and lock the socket 33 to the block 29. The tool is now ready to use. The operator slides the tool along the divider 41. As a variation in divider thickness occurs the floating blade 21 will be forced outward away from frame 1 compressing springs 9 between bracket 27 and wing nuts 11. Spring pressure will keep lips 15 and 23 flush against the sides of the divider 41 and assure continuous edge finishing of cement body 43. As the divider 41 narrows the springs 9 will force the floating blade inward along rods 3 toward frame 1. Again the lips 15 and 23 remain flush against the sides of the divider 41. This inward and outward floating action along rods 3 will continue as the tool is moved along the entire length of the divider 41. It is readily seen that if only one edge of the body 43 needs finishing blade 21 can be removed and finishing carried out only with blade 13.

Having disclosed the preferred embodiment of my invention it will be apparent to those skilled in the art that many variations could be made without departing from the true spirit and scope of my invention. I claim as my invention all such modifications as fall within the scope and equivalence of these appended claims.

I claim:

1. A cement finishing tool comprising:

a frame;

a blade mounting rod on the frame;

a first, non-floating, cement smoothing blade on the rod, the blade defining a downwardly depending lip;

a second, floating, cement smoothing blade on the rod, in opposing relation to the first blade on the rod, the second blade defining a downwardly depending lip;

a spring operatively connected to the rod and to the floating blade, the spring positioned on the rod so as to continuously urge the floating blade toward the non-floating blade;

and a handle on the frame.

2. A cement finishing tool comprising:

a frame having a blade mounting rod thereon, the rod including a spring mounted thereon;

a first, non-floating cement smoothing blade on the rod;

a second, continuously floating, spring loaded, cement smoothing blade on the rod, the second blade urged toward the first blade in opposing relation under the influence of the rod mounted spring;

and an angularly adjustable handle on the frame.

3. Apparatus according to claim 2 wherein the frist non-floating blade is adjustable relative to the frame.

4. Apparatus according to claim 2 wherein the cement finishing tool includes spring force loading nuts on the rod operatively connected to the second blade.

5. Apparatus according to claim 2 wherein the length of travel of the second blade is adjustable along the rod relative to the frame.

6. A cement finishing tool comprising:

a frame;

a plurality of elongate, parallel blade mounting rods on the frame;

a first adjustable, non-floating, cement smoothing blade defining a downwardly depending lip, the first blade attached to the rods and positioned below and parallel to the longitudinal central axis of the rods;

a second, continuously floating, cement smoothing blade defining a downwardly depending lip, the second blade attached to the rods and positioned below and parallel to the longitudinal central axis of the rods in opposing relation to the non-floating blade;

a plurality of springs on the rods interposed between the floating blade and one end of the rods;

adjustable spring load adjusting means on the rods;

and means for optionally adjusting the limit of movement of the floating blade along the rods.

* * * * *